US005480041A

United States Patent [19]

Turner

[11] Patent Number: 5,480,041

[45] Date of Patent: Jan. 2, 1996

[54] TRAILER-MOUNTED CRANE

[76] Inventor: Eugene M. Turner, 20508 Mitchell Ave., Dinwiddie, Va. 23841

[21] Appl. No.: 270,905

[22] Filed: Jun. 27, 1994

[51] Int. Cl.[6] ..... B66C 23/00

[52] U.S. Cl. ..... 212/273; 212/293; 212/299; 212/306; 414/546

[58] Field of Search ..... 212/186, 187, 212/189, 222, 180, 146, 147, 255, 262, 299, 300, 306, 273, 293; 414/546

[56] References Cited

U.S. PATENT DOCUMENTS

| | | | |
|---|---|---|---|
| 929,168 | 7/1909 | Robertson | 212/189 |
| 1,564,133 | 12/1925 | Fraser | 212/189 |
| 1,658,873 | 2/1928 | Younkman et al. | 212/222 |
| 2,750,204 | 6/1956 | Ohrmann | 212/189 |
| 3,034,660 | 5/1962 | Rau et al. | 212/187 |
| 3,212,655 | 10/1965 | Prass | 414/546 |
| 3,912,088 | 10/1975 | Bronfman | 212/147 |
| 4,889,465 | 12/1989 | Brooks | 414/546 |

FOREIGN PATENT DOCUMENTS

| | | | |
|---|---|---|---|
| 570513 | 5/1924 | France | 212/187 |
| 1186538 | 10/1985 | U.S.S.R. | 414/546 |
| 1370054 | 1/1988 | U.S.S.R. | 212/255 |

*Primary Examiner*—Michael S. Huppert
*Assistant Examiner*—Thomas J. Brahan

[57] ABSTRACT

Disclosed is a new trailer-mounted crane for providing a vehicle-trailable general purpose lightweight crane. The trailer-mounted crane comprises a flatbed trailer defining a transportable crane base. A crane boom, comprising an elongated steel channel having a sheave mounted at the distal end thereof, is pivotally connected central a top rear edge of the trailer deck such that a distal end of the boom is elevationally adjustable for hoisting, moving, and lowering loads. A telescoping boom travel limit arm prevents the boom from being raised to a dangerous vertical orientation whereupon the boom and any load suspended therefrom may fall towards operating personnel. Boom sway damping arms control swinging load induced boom yaw whereby improving overall stability of the crane. A manual load hoist winch, having a load hoist cable operably connected thereto, is secured to the trailer. A motorized boom pitch winch, having a boom pitch cable operably connected thereto, is also secured to the trailer.

11 Claims, 4 Drawing Sheets

110
136
132
118
140
122

32
20
44
22
42

TRAILER-MOUNTED CRANE

BACKGROUND OF THE INVENTION

1. Field of the Invention

The present invention relates to cranes and more particularly pertains to a trailer-mounted crane which may be adapted for providing a vehicle-trailable general purpose lightweight crane having manual load hoist and motorized boom pitch winches.

2. Description of the Prior Art

The use of cranes is known in the prior art. More specifically, cranes heretofore devised and utilized for the purpose of lifting and moving objects are known to consist basically of familiar, expected and obvious structural configurations, notwithstanding the myriad of designs encompassed by the crowded prior art which have been developed for the fulfillment of countless objectives and requirements.

The present invention is directed to improving devices for lifting and moving objects in a manner which is safe, secure, economical and aesthetically pleasing.

Relevant prior art patents include U.S. Pat. No. 5,016,768 to Kennard, Jr. et al. which discloses a pickup truck derrick with traveling sheaves. The Kennard, Jr. device consists of a complex and costly derrick well suited for commercial construction projects but poorly suited for home, farm, and small-scale use.

The prior art also discloses a portable crane as shown in U.S. Pat. No .5,224,612 to Shirley, a mobile crane of U.S. Pat. No. 5,211,526 to Robinette, a trunk-mounted portable crane in U.S. Pat. No. 5,090,580 to Nelson, and a crane counterbalancing trailer assembly of U.S. Pat. No. 3,842,984 to Brown et al. While these devices fulfill their respective, particular objectives and requirements, the aforementioned patents do not disclose a trailer-mounted crane for providing a vehicle-trailable general purpose lightweight crane having manual load hoist and motorized boom pitch winches.

In this respect, the trailer-mounted crane according to the present invention substantially departs from the conventional concepts and designs of the prior art, and in so doing provides an apparatus primarily developed for the purpose of providing a vehicle-trailable general purpose lightweight crane having manual load hoist and motorized boom pitch winches.

Therefore, it can be appreciated that there exists a continuing need for a new trailer-mounted crane which can be used for providing a vehicle-trailable general purpose lightweight crane having manual load hoist and motorized boom pitch winches. In this regard, the present invention substantially fulfills this need.

As illustrated by the background art, efforts are continuously being made in an attempt to develop devices for lifting and moving objects. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of cranes now present in the prior art, the present invention provides a new crane construction wherein the same can be utilized for providing a vehicle-trailable general purpose lightweight crane having manual load hoist and motorized boom pitch winches. As such, the general purpose of the present invention, which will be described subsequently in greater detail, is to provide a new trailer-mounted crane apparatus and method which has all the advantages of the prior art cranes and none of the disadvantages.

The invention is defined by the appended claims with the specific embodiment shown in the attached drawings. For the purpose of summarizing the invention, the invention may be incorporated into a new trailer-mounted crane for providing a vehicle-trailable general purpose lightweight crane having manual load hoist and motorized boom pitch winches. The trailer-mounted crane comprises a flatbed trailer defining a transportable crane base comprising a generally rectangular unitary trailer frame constructed of square steel tubing. The frame has a trailer hitch connecting member projecting from a front end thereof. The connecting member lies essentially coaxial the major axis of the frame and has a vehicular trailer hitch socket fixedly connected to a front end thereof for operably connecting the trailer with a towing vehicle.

An axle, transversely fixedly mounted to an underside of the frame, has a wheel on bearings rotatably mounted to each end thereof. Each wheel has a wheel rim with an inflated rubber tire removably connected thereto. A rigid, essentially planar, trailer deck is fixedly coplanarly connected to a top of the trailer frame for providing a working surface thereon and also for providing a crane mounting surface thereon.

A crane boom is pivotally connected at a proximal end thereof central a top rear edge of the trailer deck such that a distal end of the boom is elevationally adjustable for hoisting, moving, and lowering loads within a zone located behind the rear end of the trailer. The boom comprises an elongated steel channel having a vertically longitudinally oriented sheave rotationally mounted at the distal end thereof.

Boom travel limit means prevent the boom from being raised to a dangerous vertical orientation whereupon the boom and any load suspended therefrom may fall towards operating personnel located near the front end of the trailer. The boom travel limit means comprises an elongated steel tubular member having a steel rod slippedly telescoped therein. A proximal free end of the tubular member is pivotally connected central the top of the trailer deck. A distal free end of the rod is pivotally connected to the boom intermediate the ends of the boom. The tubular member has a length sufficient to prevent the boom from rising to a vertical position when the distal end of the tubular member abuts the boom.

Boom support means optionally supports the boom and any load suspended therefrom at a point along the boom intermediate the distal and proximal ends thereof whereby relieving a portion of the downward force applied to the rear end of the trailer. The boom support means comprises an elongated steel leg pivotally connected at a first end thereof to the boom intermediate the distal and proximal ends of the boom. The leg has a generally planar foot pad fixedly connected to a second end thereof. The leg also has an active position wherein the leg depends generally vertically from the boom such that the foot engages a supporting surface and an inactive position wherein the leg is pivoted to lie collateral the boom.

Boom sway damping means controls swinging load induced boom yaw whereby improving overall stability of the crane. The boom sway damping means comprises left and right opposing complimentary shock absorbing elongated brace members. Each brace member comprises an elongated steel tubular member having a steel rod slippedly telescoped therein. The tubular member has an angled proximal end portion pivotally connected near a side of the top rear edge of the trailer deck and a first abutment defined by a distal end thereof. The rod has a complimentarily angled distal end portion pivotally connected to a side of the boom intermediate the ends of the boom such that the brace members lie on a common plane with each other and with the boom.

The rod additionally has a circumferential shoulder formed thereon intermediate the distal end and a proximal end thereof defining a second abutment, the first and second abutments being in spaced facing relationship. The rod further has a compression coil spring disposed thereon between the first and second abutments. The rod is extensibly biased relative the tubular member by the spring such that the left and right opposing complimentary shock absorbing elongated brace members in combination permit the boom to yaw slightly relative the trailer when laterally stressed by a swinging load. The controlled boom yaw acts to prevent a potentially damaging oscillatory condition from occurring throughout the crane.

Winch mounting means positions the winches for ease of operator access and also for aligning the winches relative the boom. The winch mounting means comprises a flat post projecting upwardly from the trailer deck such that the lateral axis of the post lies parallel the lateral axis of the trailer. The upper end of the post extends at an angle toward the front end of the trailer. The post has an integral flange base fixedly connected central the deck near the front end of the trailer.

A load hoist winch is secured to the winch mounting means. The load hoist winch has a manual crank handle operably connected to a hoist cable takeup spool. The load hoist winch also has a hoist cable fixedly connected at a proximal end thereof to the hoist cable takeup spool. The hoist cable extends through the circumferential groove of the sheave and is terminated at a distal end thereof with a releasable load connecting link having a wrecking ball removably connected thereto whereby operation of the crank handle raises and lowers the wrecking ball.

A boom pitch winch is secured to the winch mounting means. The boom pitch winch has an electrically powered motor operably connected to a boom pitch cable takeup spool. The boom pitch winch also has a boom pitch cable fixedly connected at a proximal end thereof to the boom pitch takeup spool and fixedly connected at a distal end thereof to the boom proximal the distal end of the boom whereby operation of the motor raises and lowers the distal end of the boom. The boom pitch winch further has a source of electrical power operably connected thereto and motor control means whereby the motor may be started, stopped, and reversed.

Trailer support means prevent the trailer from pitching rearwardly about the axle when a heavy load is suspended from the boom. The trailer support means comprises left and right essentially identical vertically adjustable leg assemblies depending from opposing sides of the trailer deck proximal the rear end thereof. Each leg assembly has a downwardly projecting fork with a wheel rotationally mounted therein for engaging a supporting surface. Each leg assembly also having vertical adjustment securement means for securing the leg at a selected vertical position.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a new trailer-mounted crane for providing a vehicle-trailable general purpose lightweight crane.

It is another object of the present invention to provide a new trailer-mounted crane which may be easily and efficiently manufactured and marketed.

It is a further object of the present invention to provide a new trailer-mounted crane which is of a durable and reliable construction.

An even further object of the present invention is to provide a new trailer-mounted crane which is susceptible of a low cost of manufacture with regard to both materials and labor, and which accordingly is then susceptible of low prices of sale to the consuming public, thereby making such trailer-mounted cranes economically available to the buying public.

Still yet another object of the present invention is to provide a new trailer-mounted crane which provides in the apparatuses and methods of the prior art some of the advantages thereof, while simultaneously overcoming some of the disadvantages normally associated therewith.

Still yet another object of the present invention is to provide a new trailer-mounted crane having manual load hoist and motorized boom pitch winches.

Yet another object of the present invention is to provide a new trailer-mounted crane that is simply and inexpensively constructed to provide a crane suitable for use around the home, farm, or small construction site.

Even still another object of the present invention is to provide a new trailer-mounted crane that has built-in safety features to reduce the possibility of property damage and personal injury.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
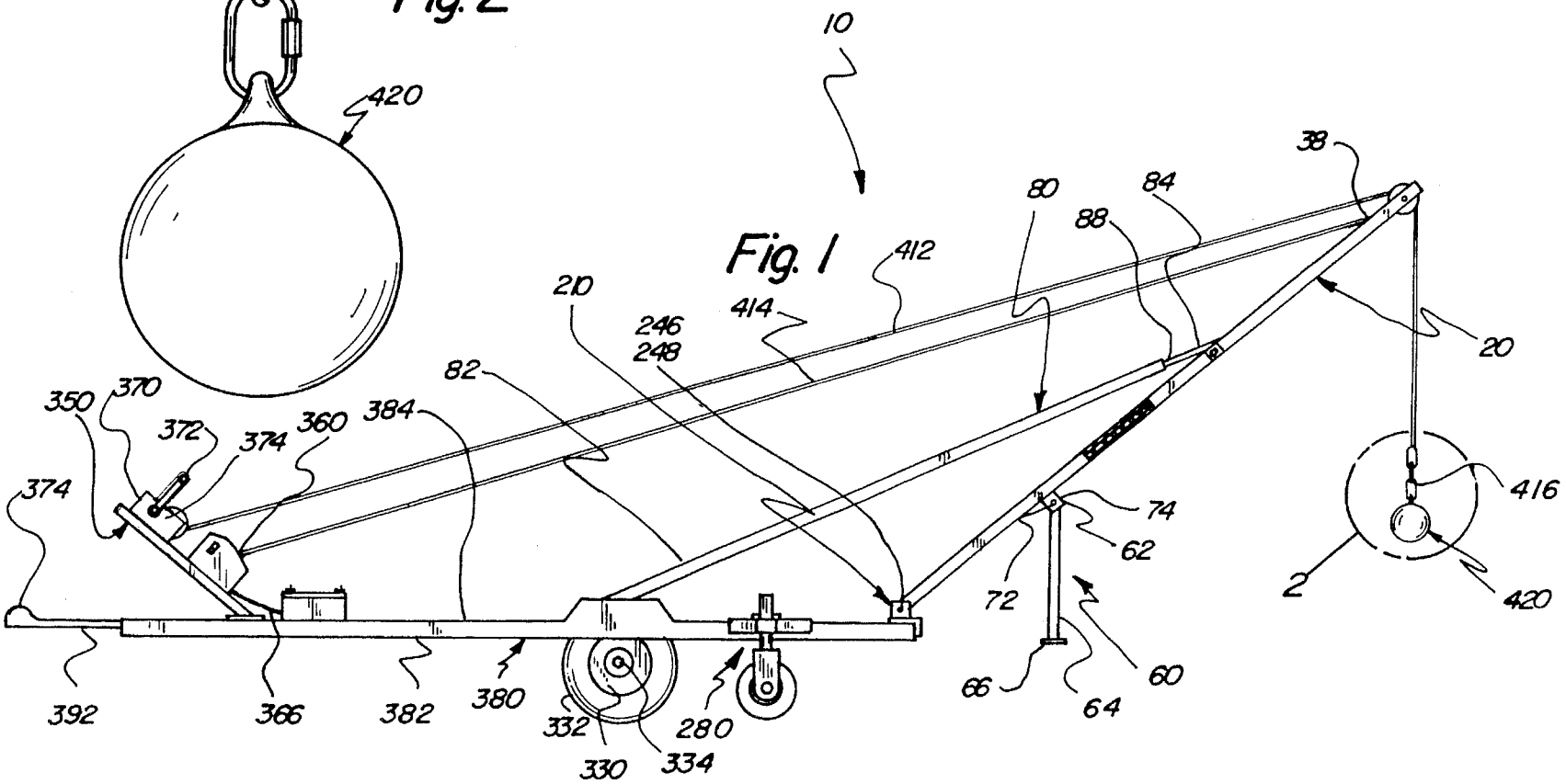
FIG. 1 is a left side elevational view of the preferred embodiment of the present invention trailer-mounted crane.
Figure 2:
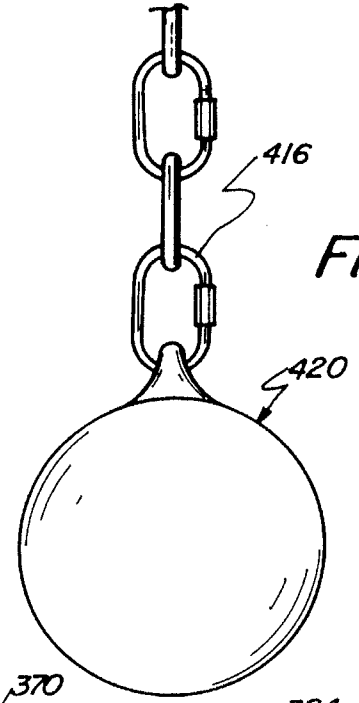
FIG. 2 is an enlarged side elevational detail view of a wrecking ball.

With reference now to the drawings, and in particular to FIG. 1 thereof, a new trailer-mounted crane embodying the principles and concepts of the present invention and generally designated by the reference numeral 10 will be described.

Figure 3:
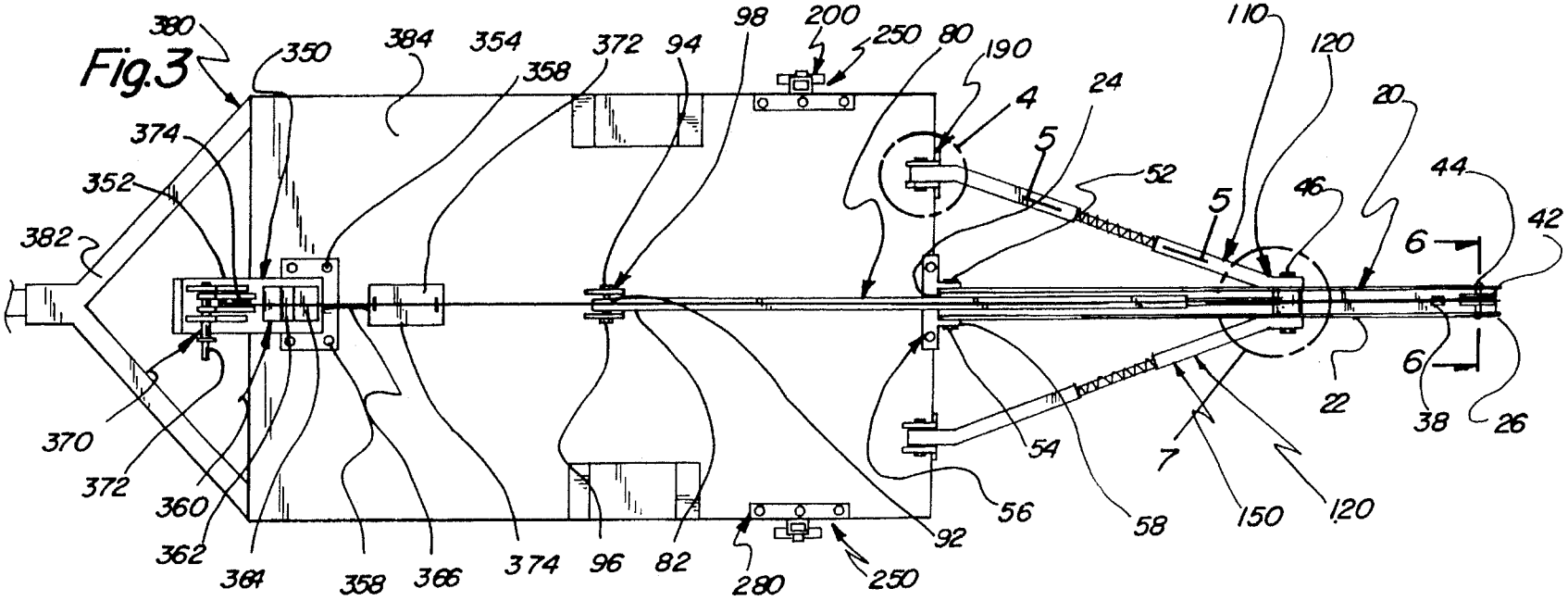
FIG. 3 is a top plan view of the invention of FIG. 1.
Figure 4:
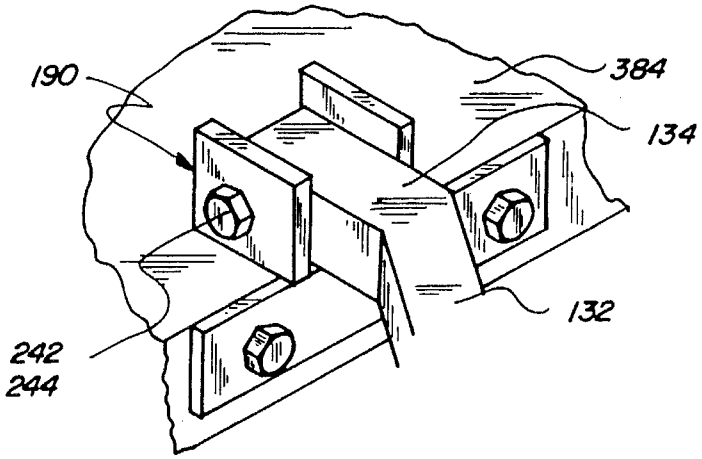
FIG. 4 is an enlarged top perspective detail view of the invention of FIG. 3 showing the manner of construction of an angled proximal end portion of a sway dampening brace and its pivotal connection to the top rear edge of the trailer deck.
Figure 5:
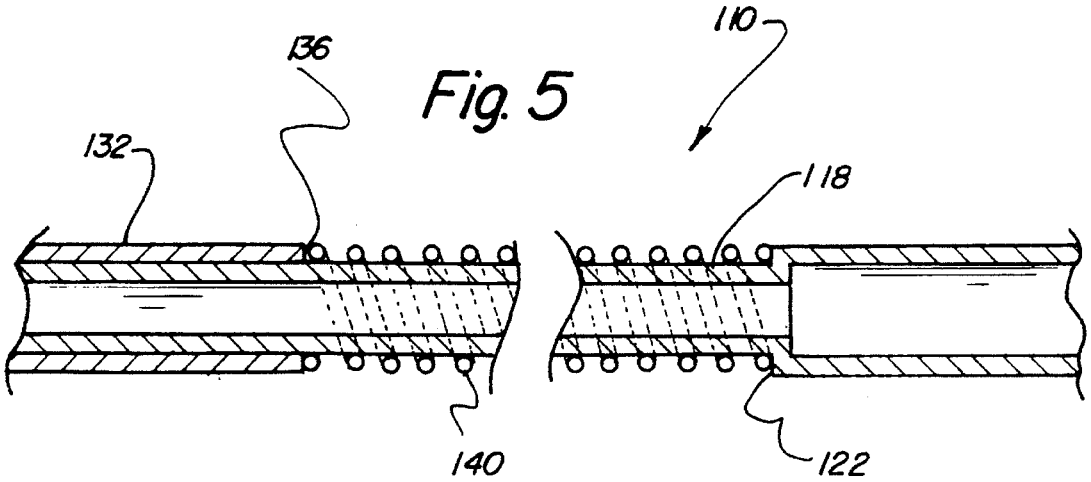
FIG. 5 is a sectional view of the invention of FIG. 3 taken along the line 5—5 and illustrating the shock absorbing spring.
Figure 6:
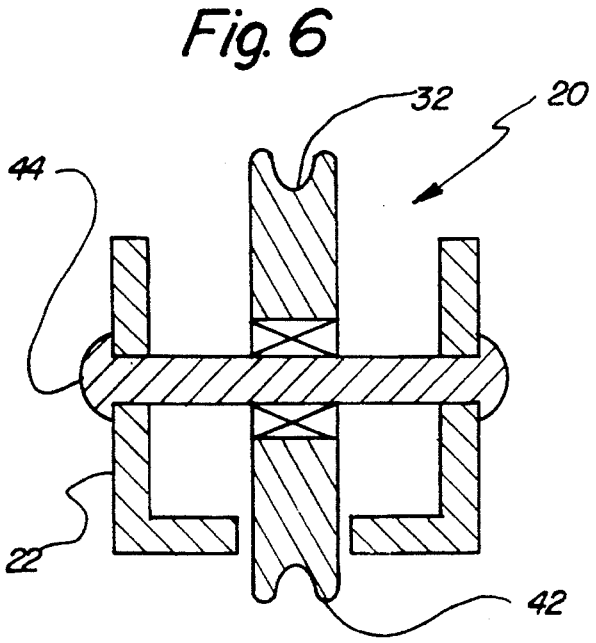
FIG. 6 is a sectional view of the invention of FIG. 3 taken along the line 6—6 and showing the manner of sheave attachment to the boom.
Figure 7:
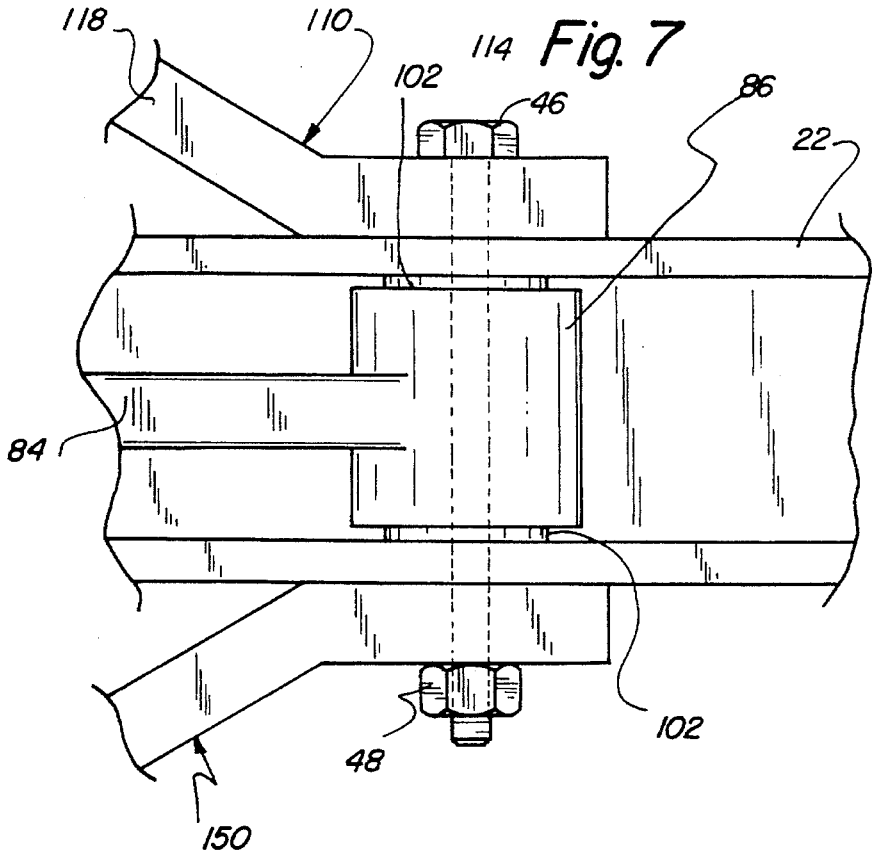
FIG. 7 is an enlarged top plan detail view of the invention of FIG. 3 showing the manner of boom travel limit rod and sway dampening rod attachment to the boom.
Figure 8:
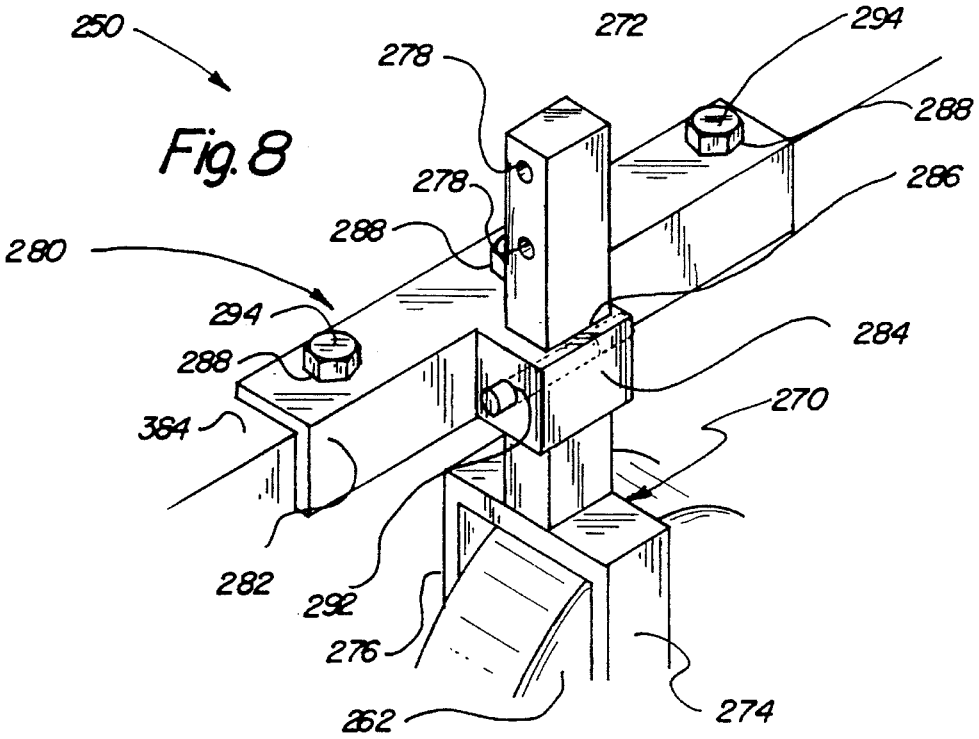
FIG. 8 is an enlarged top perspective detail view of the preferred embodiment trailer support means of the present trailer-mounted crane.

From an overview standpoint, the trailer-mounted crane is adapted for use for providing a vehicle-trailable general purpose lightweight crane having manual load hoist and motorized boom pitch winches. See FIGS. 1 and 3.

With reference now to FIGS. 1–8 and more specifically, it will be noted that a new trailer-mounted crane 10 is shown. The trailer-mounted crane 10 comprises a flatbed trailer 380 defining a transportable crane base comprising a generally rectangular unitary trailer frame 382 constructed of square steel tubing. The frame 382 has a trailer hitch connecting member 392 projecting from a front end thereof. The connecting member 392 lies essentially coaxial the major axis of the frame 382 and has a vehicular trailer hitch socket 394 fixedly connected to a front end thereof for operably connecting the trailer 380 with a towing vehicle.

An axle 334, transversely fixedly mounted to an underside of the frame 382, has a wheel 330 on bearings rotatably mounted to each end thereof. Each wheel 330 has a wheel rim with an inflated rubber tire 332 removably connected thereto. A rigid, essentially planar, trailer deck 384 is fixedly coplanarly connected to a top of the trailer frame 382 for providing a working surface thereon and also for providing a crane mounting surface thereon.

A crane boom 20 is pivotally connected at a proximal end 24 thereof central a top rear edge of the trailer deck 384 with a bracket 56 and lateral bolt 52 and nut 54 such that a distal end 26 of the boom 20 is elevationally adjustable for hoisting, moving, and lowering loads within a zone located behind the rear end of the trailer 380. The boom 20 comprises an elongated steel channel 22 having a vertically longitudinally oriented sheave 42 rotationally mounted at the distal end 26 thereof with a pin 44.

Boom travel limit means 80 prevent the boom 20 from being raised to a dangerous vertical orientation whereupon the boom and any load suspended therefrom may fall towards operating personnel located near the front end of the trailer. The boom travel limit means 80 comprises an elongated steel tubular member 82 having a steel rod 84 slippedly telescoped therein. A proximal free end 92 of the tubular member 82 is pivotally connected central the top of the trailer deck 380 with a bracket 98 and lateral bolt 94 with a nut 96. A distal free end 86 of the rod 84 is pivotally connected to the boom 20 intermediate the ends of the boom with a lateral bolt 46 extending through the boom 20, the bolt 46 being secured by a nut 48. A nylon washer 102 is disposed over the bolt 46 between facing surfaces of the rod end 86 and boom 22 to provide a smooth bearing surface. The tubular member 82 has a length sufficient to prevent the boom 80 from rising to a vertical position when the distal end 88 of the tubular member 82 abuts the boom 20.

Boom support means 60 optionally supports the boom 20 and any load suspended therefrom at a point along the boom intermediate the distal and proximal ends thereof whereby relieving a portion of the downward force applied to the rear end of the trailer 380. The boom support means 60 comprises an elongated steel leg 64 pivotally connected at a first end thereof to the boom 20 with a bracket 62 and a lateral bolt 72 with a nut 74 intermediate the distal and proximal ends of the boom 20. The leg 64 has a generally planar foot pad 66 fixedly connected to a second end thereof. The leg 64 also has an active position wherein the leg depends generally vertically from the boom 20 such that the foot 66 engages a supporting surface and an inactive position wherein the leg 64 is pivoted to lie collateral the boom 20.

Boom sway damping means 120 controls swinging load induced boom yaw whereby improving overall stability of the crane 10. The boom sway damping means 120 comprises left and right opposing complimentary shock absorbing elongated brace members 150 and 110. Since the left and right brace members 150 and 110 are essentially identical in form and function, only the right brace member 110 will be described here with every feature of the right brace member 110 having a matching feature on the left brace member 150. The right brace member 110 comprises an elongated steel tubular member 132 having a steel rod 118 slippedly telescoped therein. The tubular member 132 has an angled proximal end portion 134 pivotally connected with a bracket 190 and a bolt 242 with a nut 244 near a side of the top rear edge of the trailer deck 384. The distal end 136 of the tubular member 132 defines an abutment. The rod 118 has a complimentarily angled distal end portion 114 pivotally connected to a side of the boom 20 intermediate the ends of the boom with a bolt 46 and a nut 48 such that the brace members 150 and 110 lie on a common plane with each other and with the boom 20.

The rod 118 additionally has a circumferential shoulder 122 formed thereon intermediate the distal end and a proximal end thereof defining a second abutment, the first and second abutments 136 and 122 being in spaced facing relationship. The rod 118 further has a compression coil spring 140 disposed thereon between the first and second abutments 136 and 122. The rod 118 is extensibly biased relative the tubular member 132 by the spring 140 such that the left and right opposing complimentary shock absorbing elongated brace members 150 and 110 in combination permit the boom 20 to yaw slightly relative the trailer 380 when laterally stressed by a swinging load. The controlled boom yaw acts to prevent a potentially damaging oscillatory condition from occurring throughout the crane 10.

Winch mounting means 350 positions the winches for ease of operator access and also for aligning the winches relative the boom 20. The winch mounting means 350 comprises a flat post 352 projecting upwardly from the trailer deck 384 such that the lateral axis of the post 352 lies parallel the lateral axis of the trailer 380. The upper end of the post 352 extends at an angle toward the front end of the trailer. The post 352 has an integral flange base 354 fixedly connected with four bolts 358 central the deck 384 near the front end of the trailer 380.

A load hoist winch 370 is secured to the winch mounting means post 352 near the upper end of the post. The load hoist winch 370 has a manual crank handle 372 operably connected to a hoist cable takeup spool 374. The load hoist winch 370 also has a hoist cable 412 fixedly connected at a proximal end thereof to the hoist cable takeup spool 374. The hoist cable 412 extends through the circumferential groove 32 of the sheave 42 and is terminated at a distal end thereof with a releasable load connecting link 416 having a wrecking ball 420 removably connected thereto whereby operation of the crank handle 372 raises and lowers the wrecking ball 420.

A boom pitch winch 360 is secured to the winch mounting means post 352 near the lower end of the post. The boom pitch winch has an electrically powered motor 362 operably connected to a boom pitch cable takeup spool 364. The boom pitch winch 360 also has a boom pitch cable 414 fixedly connected at a proximal end thereof to the boom pitch takeup spool 364 and fixedly connected at a distal end 38 thereof to the boom 20 proximal the distal end of the boom whereby operation of the motor 362 raises and lowers the distal end of the boom 20.

A battery 372 mounted within a battery box 374 provides electrical power to the boom pitch winch motor 362 through an electrical interconnect cable 366.

Trailer support means 250 prevent the trailer 380 from pitching rearwardly about the axle 334 when a heavy load is suspended from the boom 20. The trailer support means 250 comprises left and right essentially identical vertically adjustable leg assemblies 280 and 300 depending from opposing sides of the trailer deck 384 proximal the rear end thereof. Since the left and right leg assemblies 280 and 300 are essentially identical in form and function, only the left leg assembly 280 will be described here with every feature of the left leg assembly 280 having a matching feature on the right leg assembly 300.

The left leg assembly 280 has a downwardly projecting fork 270 extending coaxially from an integrally connected support post 272. The support post is slippedly engaged with a cooperating collar 284 of a bracket 282 fixedly connected to the trailer deck with three bolts 288 and nuts 294. A wheel 262 is rotationally mounted between the fork arms 274 and 276 for engaging a supporting surface. The wheel 262 may be adjusted vertically by sliding the post 272 within the collar 284. The left leg assembly 280 also has vertical adjustment securement means for securing the leg at a selected vertical position. The securement means comprises four longitudinally spaced apart lateral holes 278 through the support post 272 alignable with a lateral hole 292 through the collar 284. A locking pin 296 extends through the hole through the collar 292 and also extends through a selected lateral hole through the post 284 to secure the post vertically relative the trailer 380.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

Now that the invention has been described,

What is claimed is:

1. A new trailer-mounted crane for providing a vehicle-trailable general purpose lightweight crane having manual load hoist and motorized boom pitch winches, the trailer-mounted crane comprising:

a flatbed trailer defining a transportable crane base, the trailer comprising: a generally rectangular unitary trailer frame constructed of square metal tubing, the frame having a trailer hitch connecting member projecting from a front end thereof, the connecting member lying essentially coaxial the major axis of the frame and having a vehicular trailer hitch socket fixedly connected to a front end thereof for operably connecting the trailer with a towing vehicle; an axle transversely fixedly mounted to an underside of the frame and having a wheel on bearings rotatably mounted to each end thereof, each wheel having a wheel rim with an inflated rubber tire removably connected thereto; a rigid essentially planar trailer deck fixedly coplanarly connected to a top of the trailer frame for providing a working surface thereon and also for providing a crane mounting surface thereon;

a crane boom pivotally connected at a proximal end thereof central a top rear edge of the trailer deck such that a distal end of the boom is elevationally adjustable for hoisting, moving, and lowering loads within a zone located behind the rear end of the trailer, the boom comprising an elongated metal channel having a vertically longitudinally oriented sheave rotationally mounted at the distal end thereof;

boom travel limit means for preventing the boom from being raised to a dangerous vertical orientation whereupon the boom and any load suspended therefrom may fall towards operating personnel located near the front end of the trailer, the boom travel limit means comprising an elongated metal tubular member having a metal rod slippedly telescoped therein, a proximal free end of the tubular member pivotally connected central the top of the trailer deck, a distal free end of the rod pivotally connected to the boom intermediate the ends of the boom, the tubular member having a length sufficient to prevent the boom from rising to a vertical position when the distal end of the tubular member abuts the boom;

boom support means for optionally supporting the boom and any load suspended therefrom at a point along the boom intermediate the distal and proximal ends thereof whereby relieving a portion of the downward force applied to the rear end of the trailer, the boom support means comprising an elongated metal leg pivotally connected at a first end thereof to the boom intermediate the distal and proximal ends of the boom, the leg having a generally planar foot pad fixedly connected to a second end thereof, the leg also having an active position wherein the leg depends generally vertically from the boom such that the foot engages a supporting surface, the leg further having an inactive position wherein the leg is pivoted to lie collateral the boom;

boom sway damping means for controlling swinging load induced boom yaw whereby improving overall stability of the crane, the boom sway damping means comprising left and right opposing complimentary shock absorbing elongated brace members, each brace member comprising an elongated metal tubular member having a metal rod slippedly telescoped therein, the tubular member having an angled proximal end portion pivotally connected near a side of the top rear edge of the trailer deck and a first abutment defined by a distal end thereof, the rod having a complimentarily angled distal end portion pivotally connected to a side of the boom intermediate the ends of the boom such that the brace members lie on a common plane with each other and with the boom, the rod additionally having a circumferential shoulder formed thereon intermediate the distal end and a proximal end thereof defining a second abutment, the first and second abutments being in spaced facing relationship, the rod further having a compression coil spring disposed thereon between the first and second abutments such that the rod is extensibly biased relative the tubular member such that the left and right opposing complimentary shock absorbing elongated brace members in combination permit the boom to yaw slightly relative the trailer when laterally stressed by a swinging load whereby preventing a potentially damaging oscillatory condition from occurring throughout the crane;

winch mounting means whereby winches may be positioned for ease of operator access and also for aligning the winches relative the boom, the winch mounting means comprising a flat post projecting upwardly from the trailer deck such that the lateral axis of the post lies parallel the lateral axis of the trailer and an upper end of the post extends at an angle toward the front end of the trailer, the post having an integral flange base fixedly connected central the deck near the front end of the trailer;

a load hoist winch secured to the winch mounting means, the load hoist winch having a manual crank handle operably connected to a hoist cable takeup spool, the load hoist winch also having a hoist cable fixedly connected at a proximal end thereof to the hoist cable takeup spool, the hoist cable extending through the circumferential groove of the sheave and being terminated at a distal end thereof with a releasable load connecting link whereby operation of the crank handle raises and lowers the load connecting link;

a boom pitch winch secured to the winch mounting means, the boom pitch winch having an electrically powered motor operably connected to a boom pitch cable takeup spool, the boom pitch winch also having a boom pitch cable fixedly connected at a proximal end thereof to the boom pitch takeup spool and fixedly connected at a distal end thereof to the boom proximal the distal end of the boom whereby operation of the motor raises and lowers the distal end of the boom, the boom pitch winch further having a source of electrical power operably connected thereto and motor control means whereby the motor may be started, stopped, and reversed; and trailer support means for preventing the trailer from pitching rearwardly about the axle when a heavy load is suspended from the boom, the trailer support means comprising left and right essentially identical vertically adjustable leg assemblies depending from opposing sides of the trailer deck proximal the rear end thereof, each leg assembly having a downwardly projecting fork with a wheel rotationally mounted therein for engaging a supporting surface, each leg assembly also having vertical adjustment securement means for securing the leg at a selected vertical position.

2. The trailer-mounted crane of claim 1 wherein the trailer frame, crane boom, boom travel limit means tubular member and rod, boom support means elongated leg and foot, and boom sway damping means tubular member and rod are formed of steel.

3. The trailer-mounted crane of claim 2 and further including a wrecking ball removably connected to the load connecting link.

4. A new trailer-mounted crane for providing a vehicle-trailable general purpose lightweight crane, the trailer-mounted crane comprising:

a flatbed trailer defining a transportable crane base;

a crane boom pivotally connected at a proximal end thereof central a top rear edge of the trailer such that a distal end of the boom is elevationally adjustable for hoisting, moving, and lowering loads within a zone located behind the rear end of the trailer, the boom comprising an elongated rigid channel having a vertically longitudinally oriented sheave rotationally mounted at the distal end thereof;

load hoist means for providing a load motivating force;

a hoist cable operably connected at a proximal end thereof to the load hoist means, the hoist cable extending through the circumferential groove of the sheave and being terminated at a distal end thereof with a releasable load connecting link whereby operation of the load hoist means raises and lowers the load connecting link;

boom pitch adjustment means for providing a motivating force for raising and lowering the boom;

a boom pitch cable operably connected at a proximal and thereof to the boom pitch adjustment means and fixedly connected at a distal end thereof to the boom proximal the distal end of the boom whereby operation of the boom pitch adjustment means raises and lowers the distal end of the boom;

the flatbed trailer comprising a generally rectangular unitary trailer frame constructed of square rigid tubing, the frame having a trailer hitch connecting member projecting from a front end thereof, the connecting member lying essentially coaxial the major axis of the frame and having a vehicular trailer hitch socket fixedly connected to a front end thereof for operably connecting the trailer with a towing vehicle; an axle transversely fixedly mounted to an underside of the frame and having a wheel on bearings rotatably mounted to each end thereof, each wheel having a wheel rim with an inflated rubber tire removably connected thereto; and a rigid essentially planar trailer deck fixedly coplanarly connected to a top of the trailer frame;

a boom travel limit means for preventing the boom from being raised to a dangerous vertical orientation whereupon the boom and any load suspended therefrom may fall towards operating personnel located near the front end of the trailer, the boom travel limit means comprising an elongated rigid tubular member having a rigid rod slippedly telescoped therein, a proximal free end of the tubular member pivotally connected central the top of the trailer deck, a distal free end of the rod pivotally connected to the boom intermediate the ends of the boom, the tubular member having a length sufficient to prevent the boom from rising to a vertical position when the distal end of the tubular member abuts the boom;

boom support means for optionally supporting the boom and any load suspended therefrom at an intermediate .point along the boom whereby relieving a portion of the downward force applied to the rear end of the trailer;

boom sway damping means for controlling swinging load induced boom yaw whereby improving overall stability of the crane; and trailer support means for preventing the trailer from pitching rearwardly about the axle when a heavy load is suspended from the boom.

5. The trailer-mounted crane of claim 4 wherein the boom support means comprises an elongated rigid leg pivotally connected at a first end thereof to the boom intermediate the distal and proximal ends of the boom, the leg having a generally planar foot pad fixedly connected to a second end thereof, the leg also having an active position wherein the leg depends generally vertically from the boom such that the foot engages a supporting surface, the leg further having an inactive position wherein the leg is pivoted to lie collateral the boom.

6. The trailer-mounted crane of claim 5 wherein the boom sway damping means comprises left and right opposing complimentary shock absorbing elongated brace members, each brace member comprising an elongated rigid tubular member having a rigid rod slippedly telescoped therein, the tubular member having an angled proximal end portion pivotally connected near a side of the top rear edge of the trailer deck and a first abutment defined by a distal end thereof, the rod having a complimentarily angled distal end portion pivotally connected to a side of the boom intermediate the ends of the boom such that the brace members lie on a common plane with each other and with the boom, the rod additionally having a circumferential shoulder formed thereon intermediate the distal end and a proximal end thereof defining a second abutment, the first and second abutments being in spaced facing relationship, the rod further having a compression coil spring disposed thereon between the first and second abutments such that the rod is extensibly biased relative the tubular member such that the left and right opposing complimentary shock absorbing elongated brace members in combination permit the boom to yaw slightly relative the trailer when laterally stressed by a swinging load whereby preventing a potentially damaging oscillatory condition from occurring throughout the crane.

7. The trailer-mounted crane of claim 6 wherein the trailer support means comprises left and right essentially identical vertically adjustable leg assemblies depending from opposing sides of the trailer deck proximal the rear end thereof, each leg assembly having a downwardly projecting fork with a wheel rotationally mounted therein for engaging a supporting surface, each leg assembly also having vertical adjustment securement means for securing the leg at a selected vertical position

8. The trailer-mounted crane of claim 7 wherein the load hoist means comprises a winch secured to the trailer and having a manual crank handle operably connected to a hoist cable takeup spool.

9. The trailer-mounted crane of claim 8 wherein the boom pitch adjustment means comprises a winch secured to the trailer and having an electrically powered motor operably connected to a boom pitch cable takeup spool, the boom pitch winch further having a source of electrical power operably connected thereto and motor control means whereby the motor may be started, stopped, and reversed.

10. The trailer-mounted crane of claim 9 wherein the trailer frame, crane boom, boom travel limit means tubular member and rod, boom support means elongated leg and foot, and boom sway damping means tubular member and rod are formed of steel.

11. The trailer-mounted crane of claim 10 and further including a wrecking ball removably connected to the load connecting link.

* * * * *